US009939156B2

(12) United States Patent
Miduturi et al.

(10) Patent No.: US 9,939,156 B2
(45) Date of Patent: Apr. 10, 2018

(54) ASYMMETRIC BASEPLATE COOLING WITH ALTERNATING SWIRL MAIN BURNERS

(71) Applicants: Krishna C. Miduturi, Orlando, FL (US); David M. Ritland, Winter Park, FL (US)

(72) Inventors: Krishna C. Miduturi, Orlando, FL (US); David M. Ritland, Winter Park, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 548 days.

(21) Appl. No.: 14/140,599

(22) Filed: Dec. 26, 2013

(65) Prior Publication Data

US 2014/0360156 A1 Dec. 11, 2014

Related U.S. Application Data

(60) Provisional application No. 61/831,403, filed on Jun. 5, 2013.

(51) Int. Cl.
*F23R 3/16* (2006.01)
*F23R 3/28* (2006.01)
(Continued)

(52) U.S. Cl.
CPC ..... *F23R 3/16* (2013.01); *F23R 3/005* (2013.01); *F23R 3/04* (2013.01); *F23R 3/283* (2013.01); *F23R 3/286* (2013.01); *F23R 3/12* (2013.01); *F23R 2900/03041* (2013.01); *F23R 2900/03042* (2013.01)

(58) Field of Classification Search
CPC ..... F23R 3/04; F23R 3/12; F23R 3/14; F23R 3/286; F23R 3/283; F23R 3/343; F23R 3/16; F23R 2900/03041; F23R 2900/03042; F23R 2900/03044; F23R 3/002; F23R 3/02; F23R 3/10; F23R 3/005

See application file for complete search history.

(56) References Cited

U.S. PATENT DOCUMENTS 5,353,599 A 10/1994 Johnson et al.
6,735,950 B1 5/2004 Howell et al.
(Continued)

FOREIGN PATENT DOCUMENTS

CN 2750191 Y 1/2006
CN 102472493 A 5/2012
DE 102011012414 A1 8/2012

*Primary Examiner* — Gerald L Sung
*Assistant Examiner* — Alain Chau

(57) ABSTRACT

A combustor arrangement (10) including: a pilot burner (22) having a pilot cone (62); a plurality of clockwise (130) main swirlers interposed among a plurality of counterclockwise (132) main swirlers and disposed concentrically about the pilot burner; and a base plate (40) transverse to the main swirlers. Inbound-zones (134) exist where adjacent portions (106) of adjacent flows (108) through main swirlers flow toward the pilot cone, and interposed between the inbound zones outbound zones (136) exist where adjacent portions of adjacent flows flow away from the pilot cone. The arrangement is configured to preferentially deliver more cooling fluid to the inbound zones than the outbound zones.

14 Claims, 4 Drawing Sheets

(51) Int. Cl.

| | |
|---|---|
| ***F23R 3/04*** | (2006.01) |
| ***F23R 3/00*** | (2006.01) |
| *F23R 3/12* | (2006.01) |

(56) References Cited

U.S. PATENT DOCUMENTS

| | | | | |
|---|---|---|---|---|
| 6,976,363 | B2 | 12/2005 | McMasters et al. | |
| 7,836,699 | B2 * | 11/2010 | Graves | F23C 7/004 60/737 |
| 8,113,000 | B2 | 2/2012 | Laster et al. | |
| 8,763,399 | B2 * | 7/2014 | Dodo | F23R 3/343 431/181 |
| 9,500,368 | B2 * | 11/2016 | Ryan | F23R 3/343 |
| 2010/0064691 | A1 * | 3/2010 | Laster | F23R 3/286 60/737 |
| 2010/0071378 | A1 | 3/2010 | Ryan | |
| 2010/0251725 | A1 * | 10/2010 | Dodo | F23R 3/343 60/772 |
| 2013/0019584 | A1 | 1/2013 | Koizumi et al. | |
| 2015/0075171 | A1 * | 3/2015 | Sokolov | F23R 3/04 60/772 |
| 2015/0153044 | A1 * | 6/2015 | Slobodyanskiy | F23R 3/04 60/772 |

* cited by examiner

ASYMMETRIC BASEPLATE COOLING WITH ALTERNATING SWIRL MAIN BURNERS

This application claims benefit of the 5 Jun. 2013 filing date of U.S. provisional patent application No. 61/831,403.

FIELD OF THE INVENTION

The invention is related to an optimized cooling arrangement for a base plate configured to preferentially deliver cooling fluid to regions susceptible to flashback and flame holding in a can-annular combustor that utilizes alternating swirl mains, where the optimized cooling arrangement reduces NOx and CO emissions.

BACKGROUND OF THE INVENTION

Can annular combustors for gas turbine engine may include a combustor assembly having a central pilot burner and a plurality of pre-mix main burners disposed about the pilot burner. The pilot burner typically receives a portion of a flow of compressed air received from a compressor and mixes the pilot burner flow with fuel to form a pilot burner air and fuel mixture. The pilot burner mixture may be swirled by flow control surfaces in the pilot burner that impart circumferential motion to the axially moving pilot burner mixture. This swirled flow continues within a diverging pilot cone and this arrangement produces an expanding, helically flowing pilot mixture which is ignited and which serves to anchor the combustor flame.

The main burners may be held in place around the pilot burner and extend through a base plate that is oriented transverse to the main burners. Similar to the pilot burner, each main burner receives a respective portion of the flow of compressed air received from a compressor. Each flow of compressed air flows through its respective main burner where it is mixed with fuel to form a main burner air and fuel mixture. The main burner mixture may be swirled by flow control surfaces in the main burners that impart circumferential motion to the axially moving main burner mixture. This swirled mixture continues downstream until the main burner flows and the pilot burner flow blend at which point the main burner flows are ignited by the pilot flame. The main burner mixture is usually leaner than the pilot burner mixture and hence stable combustion relies on the anchoring effect of the pilot burner mixture.

The premixing of the main burner flows is intended to reduce fuel consumption and emissions. Stability of the combustion flame in a premix combustor relies on proper premixing provided by the swirling effect of the swirlers in the main burners. Properly swirled and mixed flows reduce combustion instabilities and this, in turn, reduces lower NOx and CO emissions.

In conventional combustors the main burners are configured to impart swirl to each main burner flow in the same direction. When looking along a combustor axis, each main burner flow may be seen as rotating the same direction as the others. For example, each main burner flow may be rotating clockwise. However, in this arrangement, adjacent portions of adjacent flows travel in opposite directions. This creates shear and vortices that increase the heat release rate and emissions in the blending regions. To alleviate this it has been proposed to alternate the direction of the swirl imparted to the main burner flows such that they alternate between clockwise and counterclockwise. This is disclosed in U.S. Publication Number 20100071378 to Ryan, which is incorporated in its entirety herein.

BRIEF DESCRIPTION OF THE DRAWINGS

The invention is explained in the following description in view of the drawings that show.

DETAILED DESCRIPTION OF THE INVENTION

The present inventors have recognized that combustion arrangements using premix main burners surrounding a pilot burner may develop zones of varying fuel richness within the combustor when the swirlers in the main burners impart alternating swirls to the main burner flows. The inventors have determined that in zones where adjacent portions of adjacent main burner flows flow inbound (into the pilot flame), a fuel-rich zone may be formed. The high fuel content in these inbound zones increases a propensity for flashback and flame holding. In contrast, the inventors have determined that in zones where adjacent portions of adjacent main burner flows flow outbound (away from the pilot flame) a fuel-lean zone may be formed. The inventors have further determined that cooling fluid flowing through the base plate is entrained in the main burner flows. The inventors have exploited this knowledge and have devised a unique apparatus configured to reduce the opportunity for flashback and flame holding in such alternating swirl arrangements.

Specifically, the improved combustor apparatus described herein preferentially delivers increased cooling air flow to fuel-rich inbound zones to decrease the fuel to air mixture level in those zones. Reducing the amount of fuel in these inbound zones reduces the ability of the flame to flashback through these zones and to hold where not desired. To compensate for the increased amount of cooling flow to the inbound zones, the improved combustor apparatus may preferentially deliver reduced cooling air flow to the fuel-lean outbound zones. This associated reduction in cooling flow helps offset the increased flow of coolant to the inbound zones, and thus instead of increasing a total coolant flow through the combustor, the overall rate of cooling flow through the combustor is essentially maintained. Maintaining the same or similar overall total cooling flow helps to maintain engine efficiency and to reduce NOx and CO emissions that may otherwise be associated with an increase in total cooling air flow.

Figure 1:
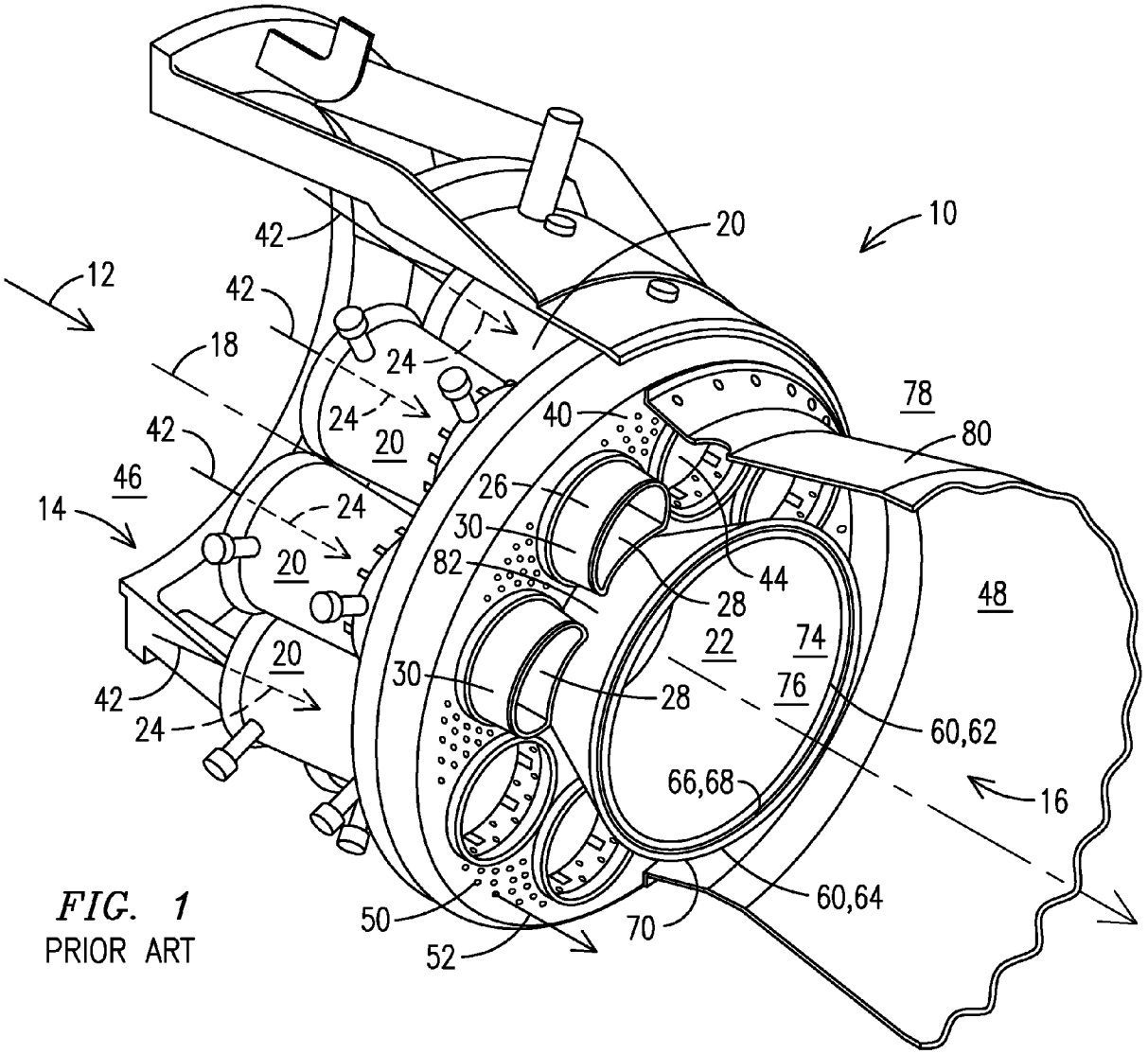
FIG. 1 PRIOR ART
FIG. 1 shows a prior art combustor arrangement of a can-annular gas turbine engine.

FIG. 1 shows a combustor arrangement 10 of a prior art can annular gas turbine engine. Compressed air 12 received from a compressor (not shown) flows generally from an upstream end 14 of the combustor arrangement 10 toward a downstream end 16 along a combustor arrangement longitudinal axis 18. A plurality of premix main burners 20 is disposed circumferentially about a pilot burner 22 and concentric to the combustor arrangement longitudinal axis 18. Each main burner 20 receives a portion of the compressed air 12, the portion thereby becoming a respective main burner flow 24 through each main burner 20. Likewise, the pilot burner receives a portion of the compressed air 12 that becomes the pilot flow (not shown). Within each main burner 20 is a swirler assembly 26 (not visible) and fuel injectors (not shown) that introduce fuel into the compressed air to create a main burner fuel and air mixture. Each swirler assembly 26 imparts circumferential movement to a respective main burner flow 24. As a result, each main burner flow 24 exhausting from a main burner outlet 28 is moving both axially and circumferentially to form a helical flow (not shown). The main burner outlet 28 may be disposed at an end of an optional main burner aft extension 30 as shown, or slightly more upstream when the optional main burner aft extension 30 is not present.

A base plate 40 is oriented transverse to the combustor arrangement longitudinal axis 18 and to the longitudinal axes 42 of each main burner 20 and helps to support each main burner 20. The base plate 40 includes main burner apertures 44 through which the main burners 20 extend. The base plate 40 separates the combustor arrangement 10, thereby forming an upstream region 46 and a downstream region 48 in which combustion occurs. Cooling apertures 50 of uniform size and a symmetric pattern are disposed about and through the base plate 40 to allow compressed air 12 to act as a cooling fluid 52 and flow through the base plate 40 to provide necessary cooling in a prior art cooling arrangement.

The pilot burner 22 likewise may include a pilot swirler (not shown) proximate the base plate 40 that imparts a swirl to the pilot flow, and fuel injectors that introduce fuel into the compressed air to create a pilot flow air-fuel mixture. The swirled pilot flow is bounded by a pilot burner cone arrangement 60 that may include an inner pilot cone 62 and an outer pilot cone 64 that surrounds the inner pilot cone 62 and defines an annular gap 66 there between. Compressed air 12 may flow in the annular gap 66 and exhaust an annular gap outlet 68. The annular gap outlet 68 may occur upstream of or flush with a pilot cone arrangement downstream end 70. The pilot burner flow anchors combustion via a pilot flame that exists in a pilot flame zone 74 proximate the pilot cone arrangement downstream end 70. Each main burner swirled flow travels from the respective main burner outlet 28 until it reaches the pilot flame zone 74 where it is ignited by the pilot flame. Together the swirled pilot flow and the swirled main burner flows form a combustion flame in a combustion flame zone 76 which is similar to the pilot flame zone 74, though larger. It can be seen that with respect to the combustor arrangement longitudinal axis 18 the swirled main flows are bounded on a radially outward side 78 by a combustor liner 80. On a radially inward side 82 the swirled main flows are bounded by the outer pilot cone 64. This radially asymmetric bounding causes radially asymmetric aerodynamics discussed further below.

Figure 2:
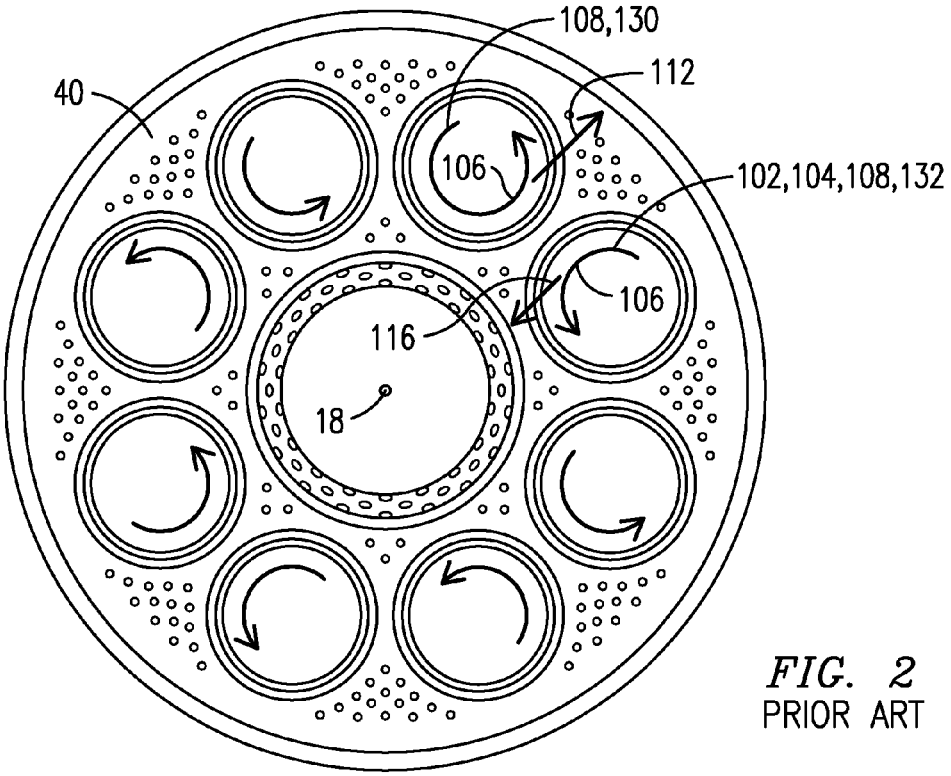
FIG. 2 PRIOR ART
FIG. 2 shows a base plate, a prior art cooling apertures, and swirl of a prior art swirler arrangement.

FIG. 2 shows the base plate 40 and associated cooling arrangement of FIG. 1 removed from the combustor arrangement 10 and looking from the downstream end 16 toward the upstream end 14 along the combustor arrangement longitudinal axis 18. In this configuration the swirler assemblies (not visible) impart swirl to each main burner flow 24 in a same direction 102 which is, in this view, counter-clockwise, thereby forming swirled main flows 104. During engine operation, as adjacent portions 106 of adjacent swirled main flows 108 travel axially along the combustor arrangement longitudinal axis 18, they eventually meet while traveling in opposite linear directions. A clockwise swirled main flow 130 is traveling in an linear outbound direction 112 away from the combustor arrangement longitudinal axis 18 and the pilot burner 22 centered there about and an adjacent, second swirled flow 132 is traveling in a linear inbound direction 116 toward the pilot burner 22. In this region the clashing of opposite flow directions causes shear and vortices and these causes combustion instabilities and increased pulsations and increased NOx and CO emissions etc.

Figure 3:
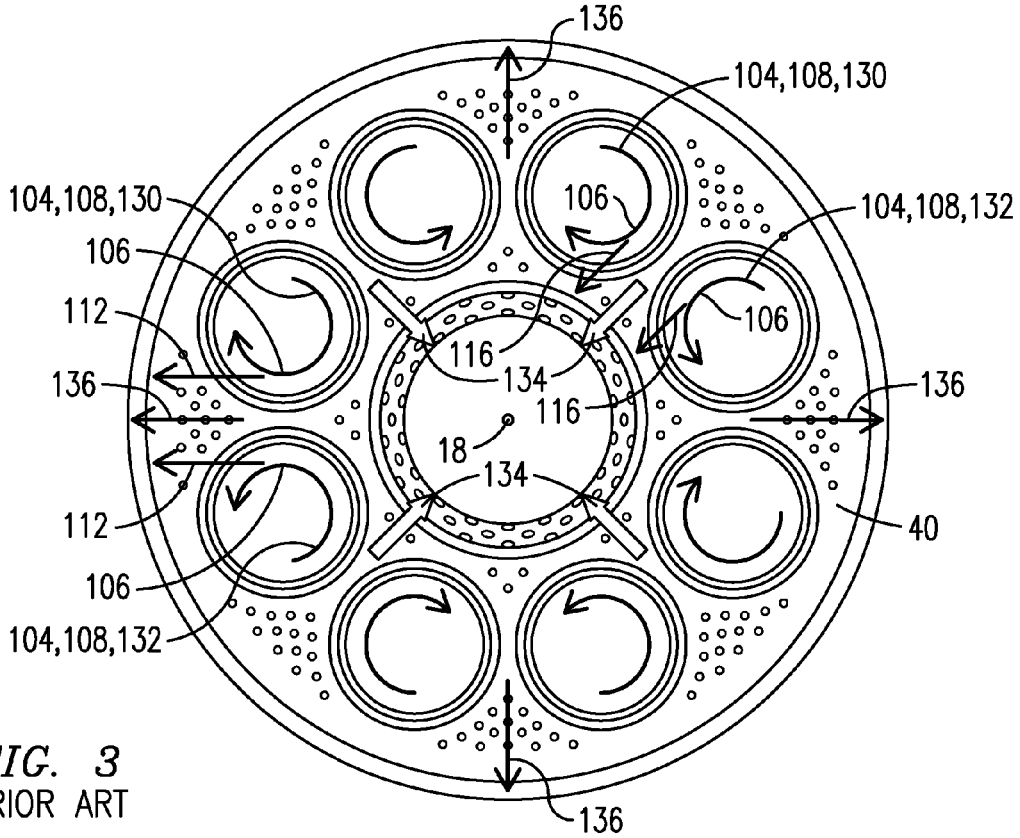
FIG. 3 PRIOR ART
FIG. 3 shows the base plate and prior art cooling apertures of FIG. 2 and swirl of an alternative prior art swirler arrangement.

To mitigate the shear and vortices caused by the clashing, a swirl configuration shown in FIG. 3 and used with the base plate 40 and associated cooling arrangement of FIG. 2 has been proposed where the swirler assemblies impart swirl to each main burner flow 24 in alternating directions. For example, every other swirled main flow 104 may be a clockwise swirled main flow 130, while interposed swirled main flows 104 may be a counter-clockwise swirled main flow 132. In such a configuration, during engine operation, as adjacent portions 106 of adjacent swirled main flows 108 travel axially along the combustor arrangement longitudinal axis 18, they eventually meet, but in contrast to the configuration of FIG. 2, when they meet they are both traveling in the same direction. In an inbound-zone 134 the adjacent portions 106 of the clockwise swirled main flow 130 and the counter-clockwise swirled main flow 132 are both traveling in the inbound direction 116. In this view, an inbound-zone is created between the clockwise swirled main flow 130 and the counter-clockwise swirled main flow 132 when the counterclockwise swirled main flow 132 is disposed adjacent to and circumferentially to the right of the clockwise swirled main flow 130. In an outbound-zone 136 the adjacent portions 106 of the counter-clockwise swirled main flow 132 and the clockwise swirled main flow 130 are both traveling in the outbound direction 112. In this view, an outbound-zone is created between the counter-clockwise swirled main flow 132 and the clockwise swirled main flow 130 when the counter-clockwise swirled main flow 132 is disposed adjacent to and circumferentially to the left of the clockwise swirled main flow 130.

Figure 4:
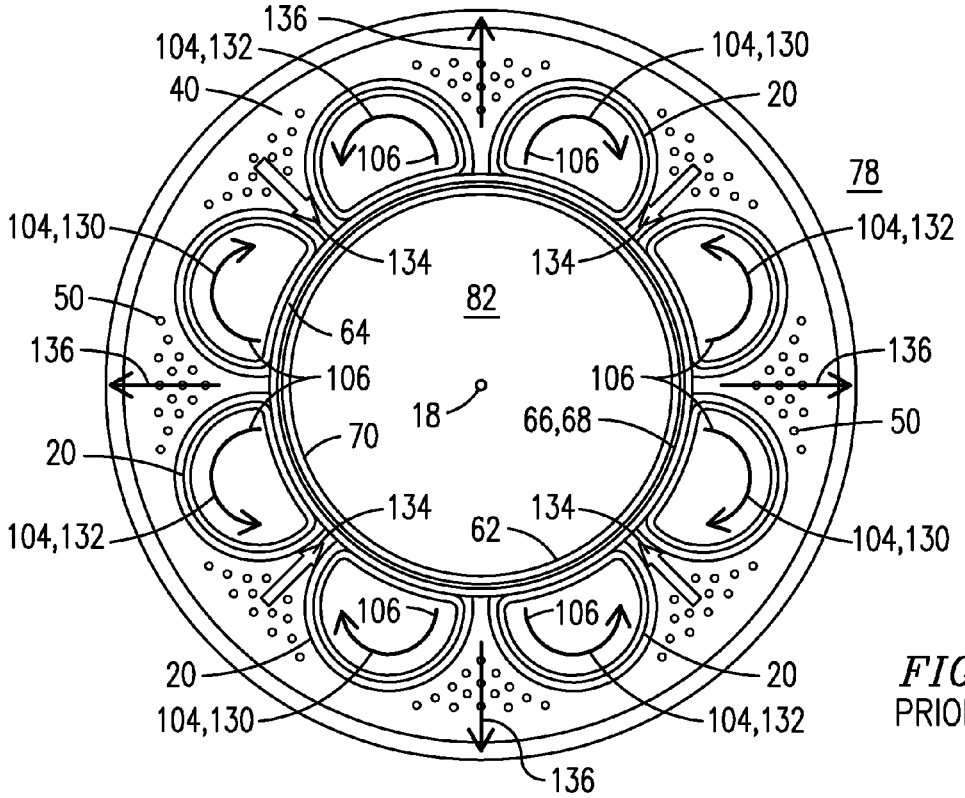
FIG. 4 PRIOR ART
FIG. 4 shows an end view of a combustor arrangement utilizing the base plate, the prior art cooling apertures, and alternative prior art swirler arrangement of FIG. 3.

FIG. 4 shows the base plate 40, the cooling arrangement, and alternating swirls of FIG. 3 together with the main burners 20 and the inner pilot cone 62, outer pilot cone 64, and the annular gap 66 as viewed from the downstream end 16 toward the upstream end 14 along the combustor arrangement longitudinal axis 18. In this view it can be seen that in the inbound-zone 134 the helically traveling clockwise swirled main flow 130 and the counter-clockwise swirled main flow 132 will rotate from the radially outward side 78 toward the radially inward side 82. Where the outer pilot cone 64 is present it blocks the inbound portions of the flows from further inbound travel, leaving the inbound portions to travel axially downstream along the outer pilot cone 64. For locations axially downstream of the pilot cone arrangement downstream end 70, the inbound portions of the flows encounter the swirled pilot flow and the swirled pilot flow acts against extensive inbound penetration. The premixed inbound portions mix with a perimeter of the premix pilot flow and flow axially along with the premix pilot flow. In contrast, when rotating from the radially inward side 82 toward the radially outward side 78 the outbound portions of the main flows will also be guided radially outward by the diverging inner pilot cone 62, enhancing the outbound effect in the outbound-zone 136. As a result, in each inbound-zone 134 the pilot flame is receiving an influx of a fuel and air mixture that contributes to the combustion flame. In contrast, in each outbound-zone 136 the pilot flame is not receiving an influx of fuel and air mixture, but instead fuel and air in the outbound-zones is being directed away from the pilot flame.

During operation the fuel from the inbound zones mixing with the perimeter of the pilot flame creates conditions that tend to allow flashback and flame holding of the combustion flame. During these conditions the flame may sit on the pilot cone and/or on the swirlers resulting in hardware damage. One factor that may contribute to the tendency of the flame to sit on the pilot cone may be the annular gap outlet 68 from which relatively slow-moving cooling fluid exhausts. The relatively slow-moving cooling fluid from the annular gap 66 mixes with the fuel and air mixture in the inbound-zone, and this slows the overall velocity of the merged cooling air and fuel and air mixture, which makes it easier for the flame to sit.

Through investigation using fluid dynamics modeling et al. the inventors were able to recognize this phenomenon. The inventors further recognized that cooling fluid 52 flowing through the cooling apertures 50 of the base plate 40 becomes entrained in the main swirled flows 104. It was noted in particular that certain portions of the cooling fluid 52 flowing through the cooling apertures 50 becomes entrained in a manner that directs the entrained flow into the inbound-zone. From this, the inventors concluded that the uniform cooling hole pattern of the prior art shown in FIG. 4 could be improved by tailoring a new pattern for the cooling apertures 50. The new pattern could preferentially deliver cooling fluid 52 to portions of the combustion arrangement more prone to flashback and flame holding due to an abundance of available fuel and/or a relatively slow flow rate, such as the inbound-zones 134. The inventors further realized that other portions of the pattern that are not delivering cooling fluid 52 to the inbound-zones 134 could be adjusted to permit less cooling flow there through. This reduction in cooling flow could be used to offset the increase in cooling flow used to direct cooling fluid 52 to the inbound-zones 134. The offset permits a total flow of cooling fluid 52 through the combustor arrangement 10 to remain the same or close to the same. Maintaining the same or similar total cooling flow prevents a reduction in engine operation efficiency associated with an increase in cooling air flow and prevents the formation of additional NOx and CO emissions often associated with an increase in cooling flow.

Figure 5:
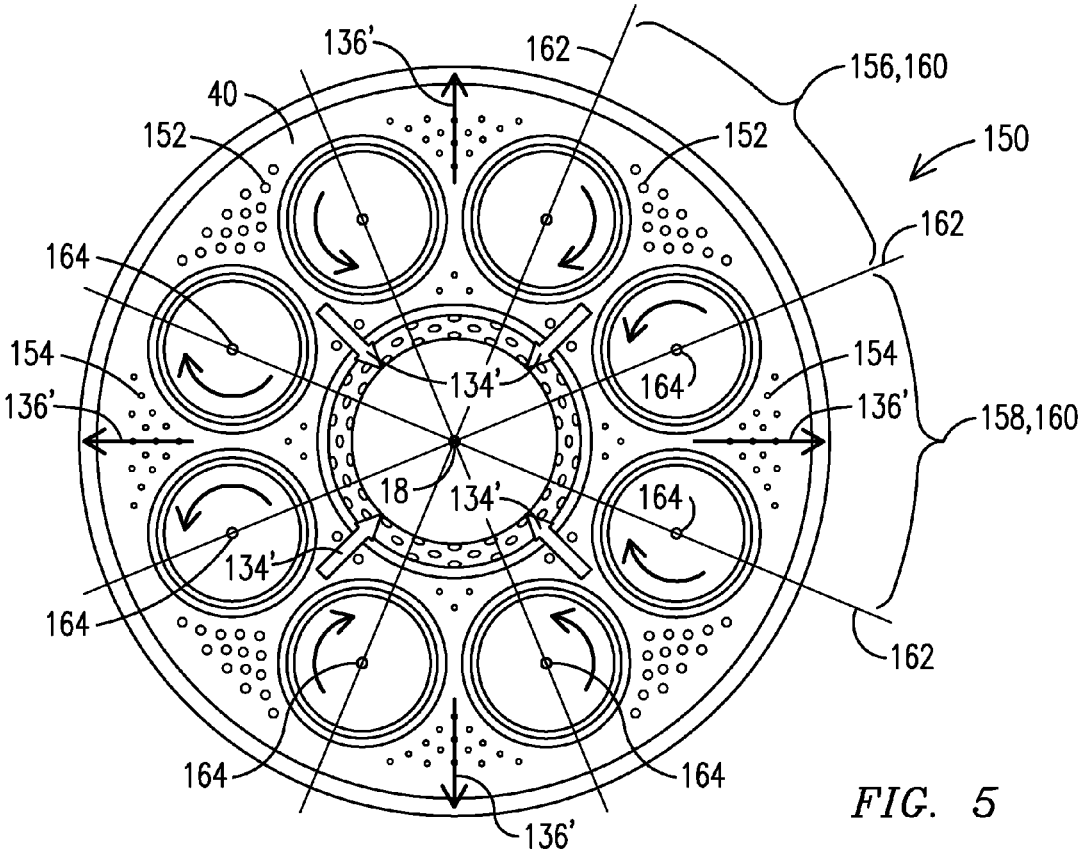
FIG. 5 shows a base plate and alternating swirl mains with a cooling arrangement disclosed herein.

FIG. 5 shows an exemplary embodiment of a new base plate cooling arrangement 150 having high-flow cooling apertures 152 and low-flow cooling apertures 154 through the base plate 40. The high-flow cooling apertures 152 define a relatively higher-flow region 156 of the base plate 40, while the low-flow cooling apertures 154 define a relatively lower-flow region 158 (compared to region 156) of the base plate 40. In this exemplary embodiment the base plate 40 is divided into even arc-sectors 160 delimited by planes 162 in which reside the combustor arrangement longitudinal axis 18 and main burner longitudinal axes 164, (which are parallel to the combustor arrangement longitudinal axis 18). Stated another way, the planes 162 extend radially from the combustor arrangement longitudinal axis 18 and bisect a main burner 20 on opposite sides of the combustor arrangement longitudinal axis 18. In this view, there are four planes 162, each bisecting two main swirlers 20. The high-flow region 156 of the base plate 40 is an arc-sector 160 that includes the high-flow cooling apertures 152. Likewise, the low-flow region 158 of the base plate 40 is an arc-sector 160 that includes the low-flow cooling apertures 154. In this exemplary embodiment the high-flow region 156 is upstream of and circumferentially aligned with a modified inbound-zone 134', and the low-flow region 158 is upstream and circumferentially aligned with a modified outbound-zone 136'. In the modified inbound-zone 134', the modification includes a relatively leaner mixture. In the modified outbound-zone 136', the modification includes a relatively richer mixture.

This configuration was selected because it was observed that cooling fluid 52 flowing through the base plate 40 at this location was entrained and delivered to the inbound-zone 134'. It was also observed that a reduction of cooling fluid 52 in the low-flow region 158 did not negatively impact the outbound-zone 136' because the outbound-zone 136' was already relatively lean, and reducing an amount of cooling fluid 52 being directed to the outbound-zone 136' tends to decrease the leanness of the mixture in the outbound-zone 136', thereby contributing to a more uniform mixture in the combustor arrangement 10. This, in turn, contributes to better combustion while also conserving the total cooling flow through the combustor arrangement 10. In the embodiment illustrated in FIG. 5, a majority of the high-flow cooling apertures 152 are disposed radially outward of the main burner longitudinal axes 164 because this location facilitates the cooling fluid 52 being entrained and delivered to the inbound-zone as desired. This configuration has been demonstrated and has proven to reduce the likelihood of flashback and flame holding.

A relatively high flow rate in the high-flow region 156 can be achieved by various ways other then by changing a diameter of the cooling apertures. For example, in the high-flow region 156 there could simply be more cooling apertures, or any combination of larger and more apertures effective to provide a relatively greater flow rate in that region. Likewise, to reduce the flow rate, smaller or fewer apertures or both may be used. In addition, other configurations of high flow regions and low flow regions effective to mitigate flashback and flame holding can be envisioned and are within the scope of this disclosure. For example, while the regions shown are arc-sectors having an arc-length of ⅛ of the total arc-length, they could take any shape, such as shorter or longer arc-lengths. Alternately, a high or low-flow region could be a circular, square, or other shape within the bounds of the base plate 40. The shape of the region could be formed to match a shape of the inbound-zone being targeted. For example, if the inbound-zone being targeted were characterized by a spherical shape, the high-flow region could be circular. Likewise, if the inbound-zone being targeted were characterized by any other shape, the high-flow region could match that shape in whatever size necessary to accommodate any flow convergence and/or divergence of the cooling fluid flowing through the high-flow region as it travels toward the inbound-zone. In this manner, a shape of a cross section of the cooling fluid flowing through the high-flow region would match a shape and/or size of a cross section of the inbound-zone when the cooling fluid reaches the inbound-zone, and a maximum amount of the inbound-zone would be infiltrated with the cooling fluid. The shaping of the high-flow region could be done in any number of ways, including simply placing several same or similar sized and/or shaped cooling apertures in the proper place in the proper shape. Alternately, individual cooling apertures of varying sizes and shapes could be assembled together in the high-flow region that, during operation, produce the desired shape for the cooling fluid flowing through the high-flow region.

Figure 6:
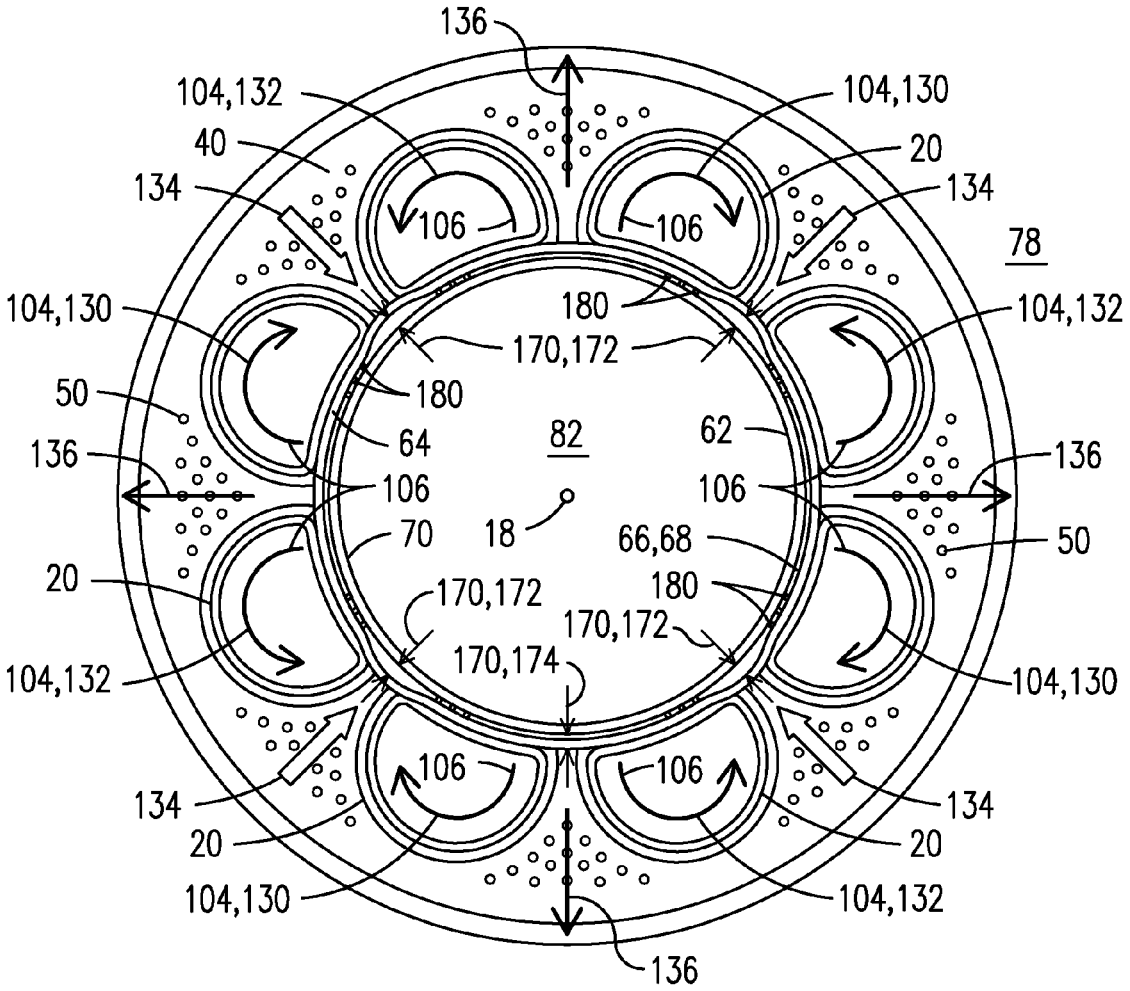
FIG. 6 shows an end view of a combustor arrangement and an alternate exemplary embodiment of the cooling arrangement disclosed herein.

In an alternate exemplary embodiment shown in FIG. 6, instead of or in addition to varying the apertures in the base plate, the pilot cone may be configured to bias the flow of cooling fluid. In one exemplary embodiment, a shape of the annular gap 66 may be varied to preferentially deliver more cooling fluid from the annular gap 66 to the inbound-zone 134 and less cooling fluid from the annular gap 66 to the outbound zone 136. This may be accomplished in an exemplary embodiment by varying a shape of the outer pilot cone 64 such that it appears to undulate circumferentially. This can produce an annular gap 66 where a width 170 of the gap varies circumferentially with the undulations. The width 170 can be such that a relatively larger width 172 is present proximate the inbound zone 134 to allow more annular gap cooling fluid to flow into the inbound zone 134. The relatively smaller width 174 is present proximate the outbound zone 136 to allow less annular gap cooling fluid to flow into the outbound zone 136. Alternately, or in addition, the inner pilot cone 62 may be similarly undulated.

Modifying the circumferential distribution of the annular gap coolant flow may be accomplished in any number of other ways. For example, flow guides 180 may be disposed within the annular gap 66, at the annular gap outlet 68 and/or upstream thereof, to direct annular gap cooling fluid preferentially into the inbound zone 134. These flow guides 180 can be used alone or in conjunction with aperture varying and/or preferential annular gap dimensioning to preferentially deliver additional cooling fluid to the inbound zone 134 and less to the outbound zone 136.

Alternately, the outer pilot cone 64 may be cut back proximate the inbound zones 134 such that, when viewed from the side, the outer pilot cone 64 may resemble a crown with cutback areas proximate the inbound zones 134 which would be effective to feed relatively more annular gap cooling fluid into the inbound zones 134. The axial projections could be disposed proximate the outbound zones 136 and would be effective to feed relatively less annular gap cooling fluid into the outbound zones 136. Various other configurations not detailed but which preferentially deliver more annular gap cooling fluid to the inbound zones 134 and less to outbound zones 136 are considered within the scope of this disclosure.

From the foregoing it can be seen that the inventors have recognized an area for potential improvement in a combustor, determined parameters affecting the performance of the combustor in that area, and developed an improved design that provides an improvement while costing very little in terms of materials and manufacturing and requiring no additional total cooling flow. Consequently, the cooling arrangement disclosed herein represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A combustor arrangement, comprising:

a pilot burner comprising a pilot cone;

a plurality of clockwise main swirlers interposed among a plurality of counterclockwise main swirlers and disposed concentrically about the pilot burner, wherein the plurality of clockwise main swirlers and the plurality of counterclockwise main swirlers define inbound-zones and outbound-zones interposed between one another, wherein each respective one of the plurality of clockwise main swirlers is configured to eject a main burner flow through a respective singular main burner outlet fluidly coupled to the respective one of the plurality of clockwise main swirlers, and wherein each respective one of the plurality of counterclockwise main swirlers is configured to eject a main burner flow through a respective singular main burner outlet fluidly coupled to the respective one of the plurality of counterclockwise main swirlers; and a base plate transverse to the main swirlers;

wherein at least one of the inbound-zones exists between a respective clockwise main swirler and a first counterclockwise main swirler adjacent at one side of the respective clockwise main swirler, where adjacent portions of adjacent flows through the respective clockwise main swirler and the first counterclockwise main swirler flow toward the pilot cone, and wherein at least one of the outbound zones exists between the respective clockwise main swirler and a second counterclockwise main swirler adjacent at another side of the respective clockwise main swirler opposite to the one side of the respective clockwise main swirler, wherein each inbound zone is a fuel-rich zone relative to a fuel-lean zone formed in each outbound zone, where adjacent portions of adjacent flows through the respective clockwise main swirler and the second counterclockwise main swirler flow away from the pilot cone;

wherein the base plate comprises a cooling arrangement comprising high-flow cooling apertures defining high-flow regions, and further comprising low-flow cooling apertures defining low-flow regions, wherein the cooling arrangement comprises one of the following:

1) the high-flow cooling apertures comprising a larger diameter than a diameter of the low-flow cooling apertures;

2) the high-flow cooling apertures comprising a larger number than a number of the low-flow cooling apertures; and 3) the high-flow cooling apertures comprising a combination of both larger diameter cooling apertures and a larger number than the number of the low-flow cooling apertures;

wherein the cooling arrangement of high-flow cooling regions and low-flow cooling regions is effective to deliver more cooling fluid to each inbound-zone than the cooling fluid delivered to each outbound zone so that a ratio of fuel-to-air in each fuel-rich zone is reduced compared to a ratio of fuel-to-air in each fuel-lean zone.

2. The combustor arrangement of claim 1, wherein the cooling arrangement of high-flow cooling apertures and low-flow cooling apertures defines the high-flow regions through each of which cooling fluid flows at a higher flow-rate, and further defines the low-flow regions through each of which the cooling fluid flows at a lower flow-rate.

3. The combustor arrangement of claim 1, wherein a respective high-flow region is circumferentially aligned with each inbound-zone.

4. The combustor arrangement of claim 3, wherein the high-flow region apertures permit the cooling fluid to flow through the base plate, and wherein in each high-flow region a majority of the high-flow region apertures are disposed radially outward of longitudinal axes of the respective adjacent main swirlers.

5. A combustor arrangement, comprising:

a pilot burner;

a plurality of premix main swirlers concentrically disposed about the pilot burner, the main swirlers alternate between a main swirler that imparts a clockwise swirl and a main swirler that imparts a counter-clockwise swirl, wherein the plurality of premix main swirlers defines inbound-zones and outbound zones interposed between one another, wherein each respective one of the plurality of premix main swirlers is configured to eject a main burner flow through a respective singular main burner outlet fluidly coupled to the respective one of the plurality of premix main swirlers; and a base plate through which the main swirlers extend, wherein the base plate comprises a cooling arrangement of high-flow cooling apertures effective to form a plurality of high-flow regions through each of which cooling fluid flows at a higher flow-rate, and low-flow cooling apertures effective to form a plurality of low-flow regions through each of which the cooling fluid flows at a lower flow-rate;

wherein at least one of the inbound-zones exists between a respective clockwise main swirler and a first counterclockwise main swirler adjacent at one side of the respective clockwise main swirler, where adjacent portions of adjacent flows through the respective clockwise main swirler and the first counterclockwise main swirler flow toward the pilot burner, and wherein at least one of the outbound zones exists between the respective clockwise main swirler and a second counterclockwise main swirler adjacent at another side of the respective clockwise main swirler opposite to the one side of the respective clockwise main swirler, where adjacent portions of adjacent flows through the respective clockwise main swirler and the second counterclockwise main swirler flow away from the pilot burner, wherein each inbound zone is a fuel-rich zone relative to a fuel-lean zone formed in each outbound zone, wherein the cooling arrangement comprises one of the following:

1) the high-flow cooling apertures comprising a larger diameter than a diameter of the low-flow cooling apertures;

2) the high-flow cooling apertures comprising a larger number than a number of the low-flow cooling apertures; and 3) the high-flow cooling apertures comprising a combination of both larger diameter cooling apertures and a larger number than the number of the low-flow cooling apertures, wherein the cooling arrangement of high-flow cooling regions and low-flow cooling regions is effective to deliver more cooling fluid to each inbound-zone than the cooling fluid delivered to each outbound zone so that a ratio of fuel-to-air in each fuel-rich zone is reduced compared to a ratio of fuel-to-air in each fuel-lean zone.

6. The combustor arrangement of claim 5, wherein the low-flow regions are circumferentially interposed between adjacent high-flow regions.

7. The combustor arrangement of claim 6, wherein a respective high-flow region is demarked by planes radial to a pilot burner longitudinal axis and which bisect respective adjacent main swirlers surrounding a respective inbound-zone.

8. The combustor arrangement of claim 7, wherein low-flow regions are those portions of the base plate in between the high-flow regions.

9. The combustor arrangement of claim 5, wherein a respective high-flow region is circumferentially aligned with each inbound-zone.

10. The combustor arrangement of claim 5, wherein cooling apertures through the base plate that are associated with a respective high-flow region are positioned such the cooling fluid flowing through the respective high-flow region flows into a respective inbound-zone adjacent a pilot cone of the pilot burner.

11. The combustor arrangement of claim 5, wherein the pilot burner comprises: an inner cone; and an outer cone surrounding the inner cone and defining an annular gap there between, wherein the annular gap defines a passageway for cooling fluid to flow there through, and wherein cooling fluid exiting the annular gap enters the inbound-zone.

12. A combustor arrangement comprising:

a plurality of alternately rotating main swirlers disposed about a pilot burner comprising a pilot cone, wherein converging flows created by adjacent main swirlers create alternating inbound and outbound flow regions relative to the pilot cone, wherein each respective one of the plurality of alternately rotating main swirlers is configured to eject a main burner flow through a respective singular main burner outlet fluidly coupled to the respective one of the plurality of alternately rotating main swirlers;

a base plate through which the main swirlers extend; and wherein at least one of the inbound-zones exists between a respective clockwise main swirler and a first counterclockwise main swirler adjacent at one side of the respective clockwise main swirler, where adjacent portions of adjacent flows through the respective clockwise main swirler and the first counterclockwise main swirler flow toward the pilot cone, wherein at least one of the outbound zones exists between the respective clockwise main swirler and a second counterclockwise main swirler adjacent at another side of the respective clockwise main swirler opposite to the one side of the respective clockwise main swirler, where adjacent portions of adjacent flows through the respective clockwise main swirler and the second counterclockwise main swirler flow away from the pilot cone; and wherein the base plate comprises a cooling arrangement comprising high-flow cooling apertures defining high-flow regions, and further comprising low-flow cooling apertures defining low-flow regions, wherein the cooling arrangement comprises one of the following:

1) the high-flow cooling apertures comprising a larger diameter than a diameter of the low-flow cooling apertures;

2) the high-flow cooling apertures comprising a larger number than a number of the low-flow cooling apertures; and 3) the high-flow cooling apertures comprising a combination of larger diameter cooling apertures and a larger number than the number of the low-flow cooling apertures, wherein the cooling arrangement of high-flow cooling regions and low-flow cooling regions is effective to deliver more cooling fluid to each inbound-zone than cooling fluid delivered to each outbound zone so that a ratio of fuel-to-air in each fuel-rich zone is reduced compared to a ratio of fuel-to-air in each fuel-lean zone.

13. The combustor arrangement of claim 12, further comprising:

a higher number of cooling apertures formed in the base plate in regions upstream of the inbound flow regions than a number of cooling apertures formed in the base plate in regions upstream of the outbound flow regions.

14. The combustor arrangement of claim 12, further comprising:

cooling apertures having a larger cross-section formed in the base plate in regions upstream of the inbound flow regions than a cross-section of cooling apertures formed in the base plate in regions upstream of the outbound flow regions.

* * * * *